US005819150A

United States Patent [19]

Hayasaki et al.

[11] Patent Number: 5,819,150

[45] Date of Patent: Oct. 6, 1998

[54] IMAGE HEATING APPARATUS

[75] Inventors: Minoru Hayasaki; Hiroshi Mano, both of Numazu; Atsuyoshi Abe, Susono; Kiyofumi Nakane, Abiko, all of Japan

[73] Assignee: Canon Kabushiki Kaisha, Tokyo, Japan

[21] Appl. No.: 883,080

[22] Filed: Jun. 26, 1997

[30] Foreign Application Priority Data

Jun. 28, 1996 [JP] Japan ..... 8-188633

[51] Int. Cl.[6] ..... G03G 15/20

[52] U.S. Cl. ..... 399/330; 399/335

[58] Field of Search ..... 399/320, 328, 399/330, 335; 219/619, 670, 671, 672, 216

[56] References Cited

U.S. PATENT DOCUMENTS

| | | | |
|---|---|---|---|
| 4,112,285 | 9/1978 | Pan et al. | 399/335 X |
| 4,570,044 | 2/1986 | Kobayashi et al. . | |
| 4,912,514 | 3/1990 | Mizutani | 219/216 X |
| 5,526,103 | 6/1996 | Kato et al. . | |
| 5,534,987 | 7/1996 | Ohtsuka et al. . | |
| 5,552,582 | 9/1996 | Abe et al. | 219/216 X |
| 5,552,874 | 9/1996 | Ohtsuka et al. . | |
| 5,666,627 | 9/1997 | Yamaguchi | 399/330 |

FOREIGN PATENT DOCUMENTS 0 649 072 4/1995 European Pat. Off. .

OTHER PUBLICATIONS

Patent Abstracts of Japan, vol. 096, No. 006, 28 Jun. 1996, & JP 08–044226 (Canon Inc.), 16 Feb. 1996.

U.S. application No. 08/687,781, Abe et al. filed Jul. 1996, Assignee, Canon Kabushiki Kaisha.

*Primary Examiner*—Sandra L. Brase

*Attorney, Agent, or Firm*—Fitzpatrick, Cella, Harper & Scinto

[57] ABSTRACT

An image heating apparatus is constructed by a heat generating member having a conductive layer and a magnetic field generating apparatus for generating a magnetic field. The magnetic field generating apparatus has an exciting coil and an electric power is supplied from a power source to the exciting coil by a switching circuit. An eddy current is generated in the heating member by the magnetic field generated by the magnetic field generating apparatus, the heat generating member generates a heat by the eddy current, and an image on a recording material is heated by the heat. The exciting coil has a first coil portion and a second coil portion for matching the impedances of the first coil portion and the heat generating member. The first coil portion and the second coil portion are neighboring. The magnetic coupling between the second coil portion and the heat generating member is weaker than that between the first coil portion and the heat generating member. The second coil portion is away from the heat generating member than the first coil portion. The first coil portion and the second coil portion are serially connected. The number of turns of the second coil portion is smaller than that of the first coil portion.

11 Claims, 10 Drawing Sheets

NOTES:

⊗ REPRESENTS CONDITION IN WHICH CURRENT FLOWS DOWNWARDLY IN A DIRECTION PERPENDICULAR TO THE PLANE OF PAPER.

↑ REPRESENTS DIRECTION OF MAGNETIC FLUX.

IMAGE HEATING APPARATUS

BACKGROUND OF THE INVENTION

1. Field of the Invention

The invention relates to an image heating apparatus which is applied to an image forming apparatus such as copying apparatus, printer, or the like and, more particularly, to an apparatus for allowing a heating member to generate a heat by a magnetic induction.

2. Related Background Art

In recent years, a fixing apparatus of "magnetic induction heating system" has been devised in consideration of a fast printing time and adequate pressure/temperature response characteristics.

The fixing apparatus of the magnetic induction heating system is an apparatus having a construction such that a high frequency current is applied to an exciting coil (coil, winding, field winding, field coil) and a heat generation by a surface current on the surface of a magnetic material serving as a heat generator by a high frequency magnetic field developed is applied as it is to toner.

According to such a fixing apparatus, heat transfer model is very simple (for example, generation of magnetism→heat generation of the magnetic material→rubber layer heat transfer→melting of the toner) and a transfer response speed of the heat can be remarkably improved as compared with that of a heating roller system or a film heating system using a ceramic heater.

According to a power supplying apparatus for supplying an electric power to the fixing apparatus of the magnetic induction heating system as mentioned above, a power source of a voltage resonant system in which a switching loss is reduced and a cost advantage is high is used. According to the power source of the voltage resonant system, a method of vibrating a flyback voltage when a switching element is OFF becomes a condition to reduce the switching loss.

Therefore, the matching between the magnetic material serving as a heat generator and the exciting coil, namely, the matching of the impedance is given much weight in the development. In such a situation, a matching transformer or a matching coil is generally used in order to perform the matching with a load impedance.

In the impedance matching of a switching element by the matching transformer of the prior art, it is expected to obtain a good switching state in principle and on the operation. However, an electric power to be treated in the invention is on a level of an electric power of 1100 W or more at the time of leading. When the matching transformer is actually designed, a size of transformer results in a cube in which one side exceeds 70 mm because of a magnitude of a current to flow. In case of installing the transformer of such a size, its size occupies almost the half of a size of power supply apparatus constructed to heat a fixing apparatus. Such an increase in costs of the transformer exceeds the costs of parts used in a switching circuit.

Since the matching coil is provided at another location as another member different from the exciting coil, it is necessary to design an enclosing space for the matching coil or the like. There is a problem such that a construction of the apparatus becomes complicated.

SUMMARY OF THE INVENTION

It is an object of the invention to provide an image heating apparatus for reducing a switching loss without making the apparatus complicated.

Another object of the invention is to provide an image heating apparatus in which an exciting coil for allowing a heat generator to generate a heat has a first coil portion and a second coil portion to match impedances of the first coil portion and the heat generator and the first and second coil portions are neighboring.

The above and other objects and features of the present invention will become apparent from the following detailed description and the appended claims with reference to the accompanying drawings.

DETAILED DESCRIPTION OF THE PREFERRED EMBODIMENTS

An embodiment of the invention will now be described hereinbelow with reference to the drawings.

Figure 1:
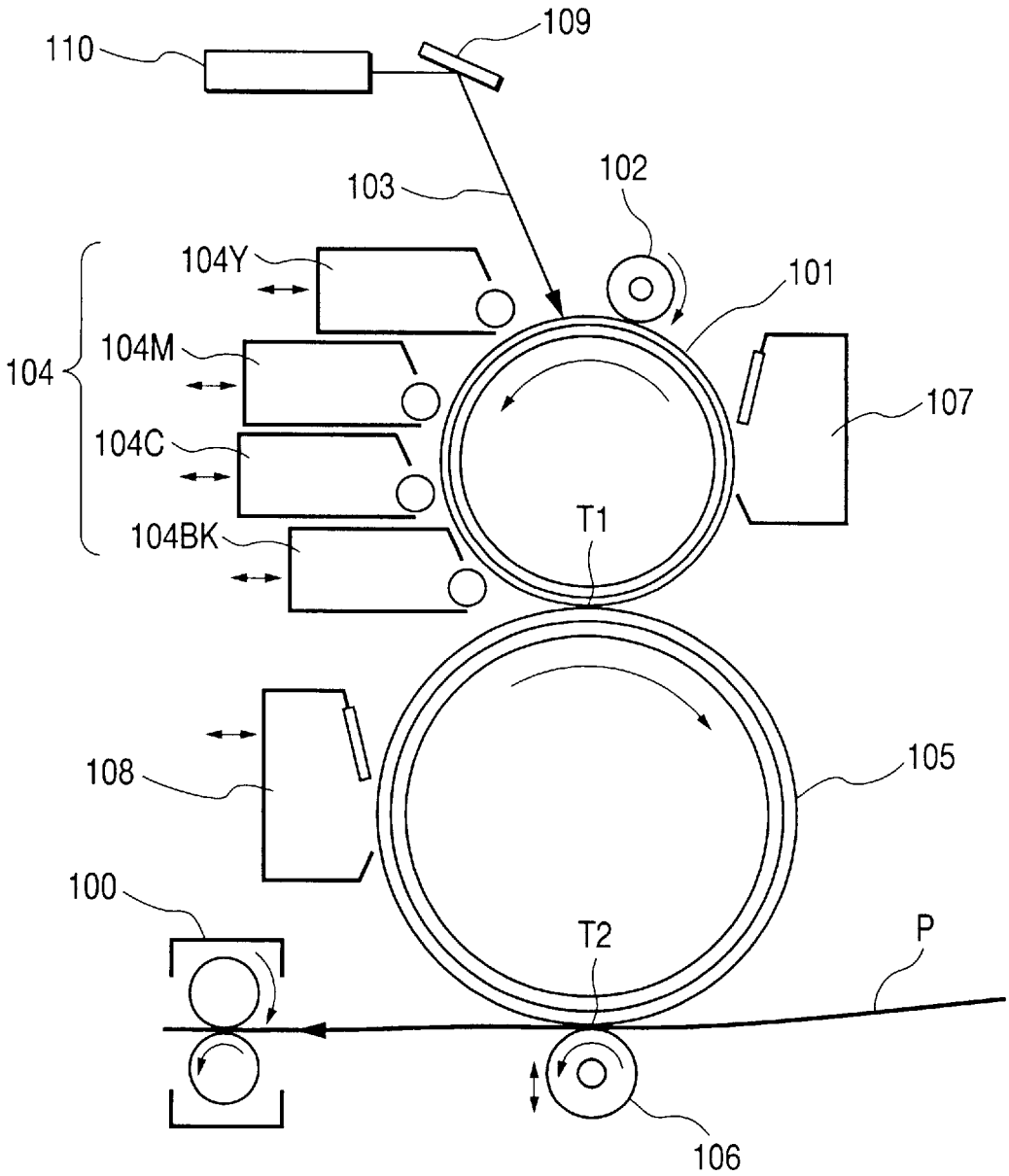
FIG. 1 is a schematic diagram of an image forming apparatus to which an image heating apparatus according to an embodiment of the invention is applied.

FIG. 1 is a schematic constructional view of an example of an image forming apparatus. The image forming apparatus of the embodiment relates to an electrophotographic color printer.

Reference numeral 101 denotes an electrophotographic photosensitive drum (image holding member) which is made of an organic photosensitive material or amorphous silicon photosensitive material. The drum 101 is rotated at a predetermined processing speed (peripheral velocity) counterclockwise as shown by an arrow.

The photosensitive drum 101 is subjected to a uniform charging process of predetermined polarity and potential by a charging apparatus 102 such as a charging roller or the like in its rotating step.

Subsequently, a charge processing surface is subjected to a scan exposing process of target image information by a laser beam 103 which is emitted from a laser optical box (laser scanner) 110. The laser scanner 110 generates the laser beam 103 which was modulated (turned on/off) in correspondence to a time sequential electric digital pixel signal of the target image information from an image signal generating apparatus such as an image reading apparatus or the like (not shown), thereby scanning and exposing the surface of the rotary photosensitive drum. By the scan exposure, an electrostatic latent image corresponding to the target image information which was scanned and exposed is formed on the surface of the rotary photosensitive drum 101. Reference numeral 109 denotes a mirror for deflecting the laser beam emitted from the laser scanner 110 to an exposing position of the photosensitive drum 101.

In case of forming a full color image, a scan exposure and a formation of a latent image are performed with respect to a first color separation component image of a target full color image, for example, a yellow component image. The latent image is developed as a yellow toner image by the operation of a yellow developing unit 104Y in a 4-color developing apparatus 104. The yellow toner image is transferred onto the surface of an intermediate transfer drum 105 in a primary transfer portion T1 as a contact portion (or proximity portion) between the photosensitive drum 101 and intermediate transfer drum 105. After the toner image was transferred onto the surface of the intermediate transfer drum 105, the adhered residual matters such as transfer residual toner and the like on the surface of the rotary photosensitive drum 101 are removed and the surface is cleaned by a cleaner 107.

A processing cycle of the charge, scan exposure, development, primary transfer, and cleaning is sequentially executed with respect to each of a second color separation component image (for example, a magenta component image; in this case, a magenta developing unit 104M operates), a third color separation component image (for example, a cyan component image; in this case, a cyan developing unit 104C operates), and a fourth color separation component image (for example, a black component image; in this case, a black developing unit 104BK operates) of a target full color image. Thus, toner images of four colors of a yellow toner image, a magenta toner image, a cyan toner image, and a black toner image are sequentially overlapped and transferred onto the surface of the intermediate transfer drum 105, thereby synthesizing and forming a color toner image corresponding to a target full color image.

The intermediate transfer drum 105 has an elastic layer of a middle resistance and a surface layer of a high resistance on a metal drum. The drum 105 is rotated clockwise as shown by an arrow at almost the same peripheral speed as that of the photosensitive drum 101 in contact with the photosensitive drum 101 or in close vicinity thereto. A bias potential is applied to the metal drum of the intermediate transfer drum 105 and a toner image on the photosensitive drum 101 side is transferred to the surface side of the intermediate transfer drum 105 by a potential difference between the metal drum and the photosensitive drum 101.

In a secondary transfer portion T2 serving as a contact nipping portion between the rotary intermediate transfer drum 105 and a transfer roller 106, the color toner image synthesized and formed on the surface of the rotary intermediate transfer drum 105 is transferred onto the surface of a recording material P fed from a paper feeding unit (not shown) to the secondary transfer portion T2 at a predetermined timing. By supplying charges of a polarity opposite to that of the toner from the back surface of the recording material P, the transfer roller 106 sequentially transfers the synthesized color toner image in a lump from the surface side of the intermediate transfer drum 105 to the recording material P.

The recording material P which passed through the secondary transfer portion T2 is separated from the surface of the intermediate transfer drum 105 and is fed to an image heating apparatus (fixing apparatus) 100 and is subjected to a heating fixing process of a non-fixed toner image. After that, the recording material P is ejected as a color image formed matter to a paper ejection tray (not shown) out of the apparatus. The fixing apparatus 100 will be explained hereinafter.

After the color toner image was transferred to the recording material P, adhered residual matters such as transfer residual toner, paper powder, and the like on the surface of the rotary intermediate transfer drum 105 are removed and the surface is cleaned by a cleaner 108. The cleaner 108 is always held to the intermediate transfer drum 105 in a non-contact state. The cleaner 108 is held to the intermediate transfer drum 105 in a contact state in a secondary transfer executing step of transferring the color toner image onto recording material P from the intermediate transfer drum 105.

The transfer roller 106 is also always held to the intermediate transfer drum 105 in a non-contact state. The transfer roller 106 is held to the intermediate transfer drum 105 in a contact state through the recording material P in the secondary transfer executing step of transferring the color toner image onto the recording material P from the intermediate transfer drum 105.

A printing mode of a monochromatic image such as a white and black image or the like can be also executed. A both-side image printing mode or a multiple image printing mode can be also executed.

In case of the both-side image printing mode, the recording material P on which an image had been printed to the first side and was ejected out of the image heating apparatus 100 is reversed upside down through a recirculation conveying mechanism (not shown) and is again fed to the secondary transfer portion T2 and a toner image is transferred to the second side. After that, the recording material P is again fed to the image heating apparatus 100 and the toner image is fixed to the second side. Thus, a both-side image print is outputted.

In case of the multiple image printing mode, the recording material P after completion of the image printing of the first time and was ejected out of the image heating apparatus 100 is not reversed upside down through the recirculation conveying mechanism (not shown) but is again fed to the secondary transfer portion T2. A toner image of the second time is transferred to the surface on which the image of the first time has already been printed. The recording material is again fed to the image heating apparatus 100 and the toner image of the second time is fixed, so that a multiple image print is outputted.

In the embodiment, toner containing a low softening substance is used.

The fixing apparatus 100 of the embodiment is an apparatus of a pressure roller driving system and a magnetic induction heating system using a cylindrical magnetic induction exothermic film (metal heating film) as a fixing film.

Figure 2A:
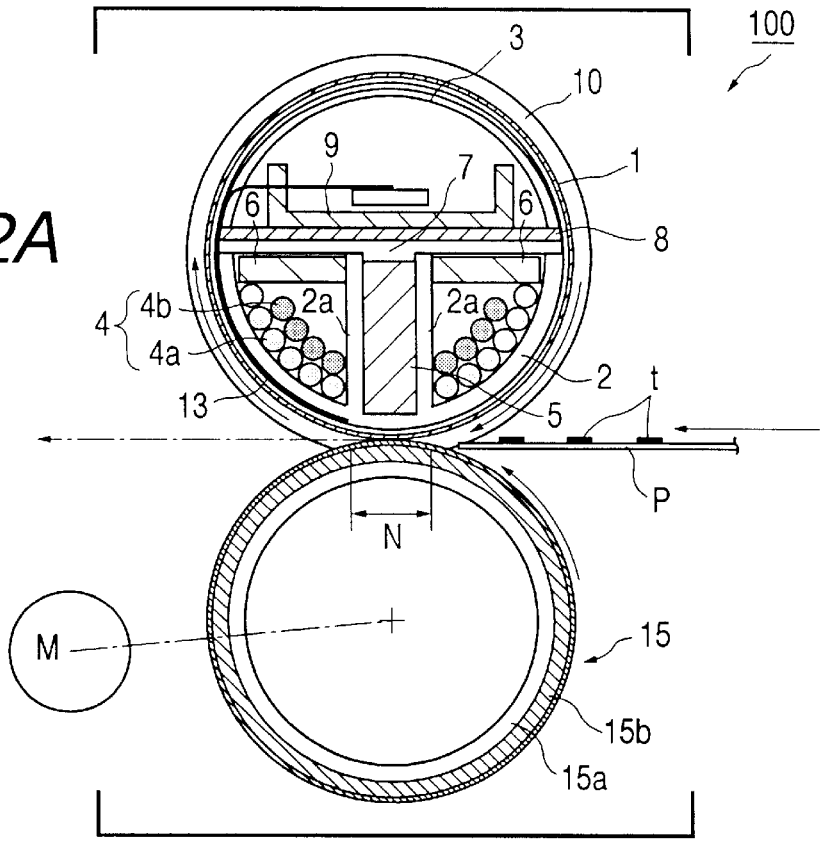
FIG. 2A is a side sectional view of the image heating apparatus.
Figure 2B:
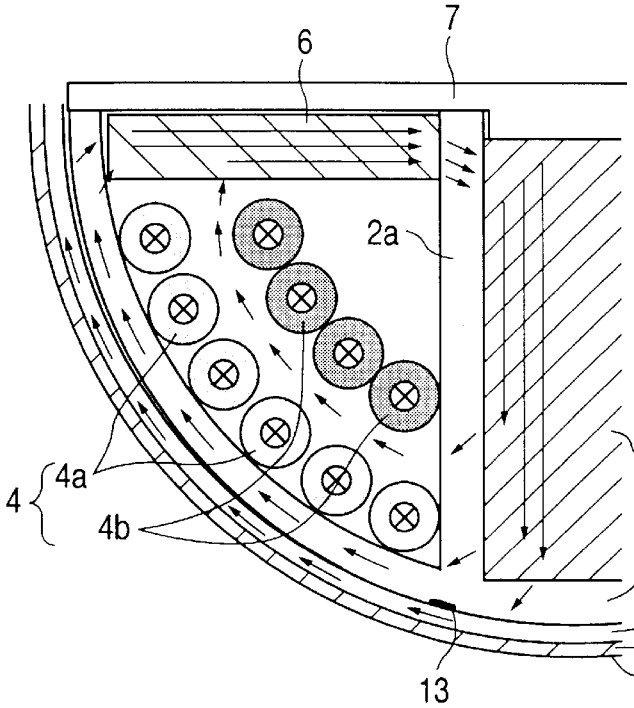
FIG. 2B is a partial enlarged diagram of the apparatus.
Figure 3:
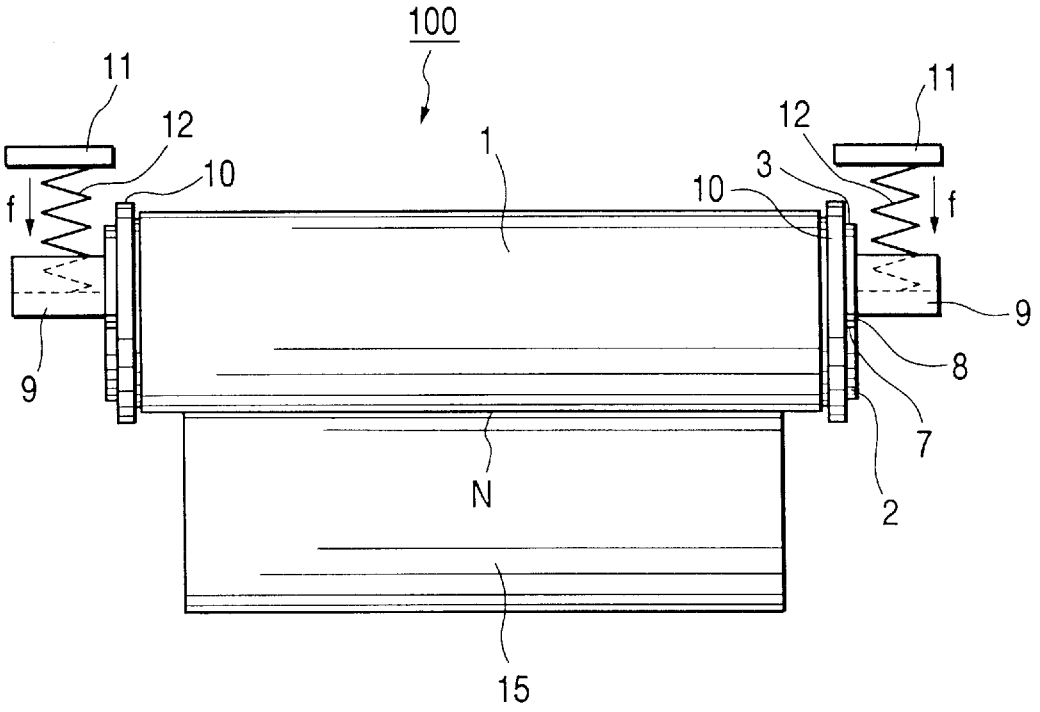
FIG. 3 is a front view of the image heating apparatus.
Figure 4:
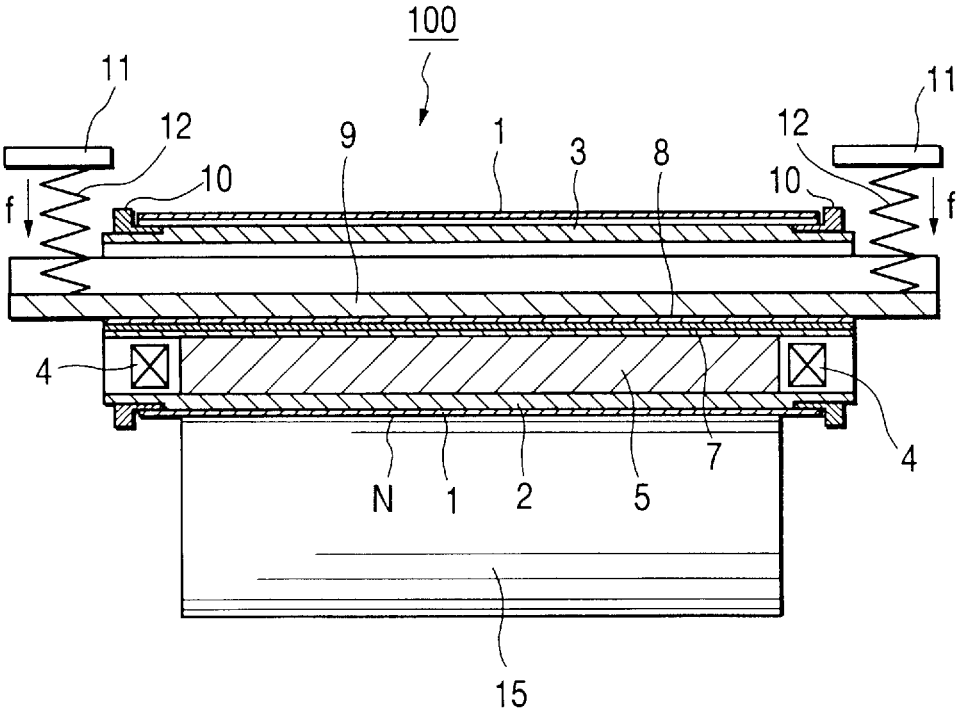
FIG. 4 is a front sectional view of the image heating apparatus.

FIG. 2A is a cross side sectional view of a main portion of the fixing apparatus 100. FIG. 2B is a partial enlarged diagram of the fixing apparatus. FIG. 3 is a front diagram of the apparatus 100. FIG. 4 is a vertical sectional front diagram.

Reference numeral 1 denotes a magnetic induction exothermic film (hereinafter, referred to as a fixing film) as a cylindrical heat generator. As shown in the layer structural diagram of FIG. 2B, the fixing film 1 of the embodiment is a laminated film material comprising: a conductive layer (metal layer, resistive layer, magnetic layer) 1*a* serving as a heat generator which performs a magnetic induction heat generation, for example, a cylindrical nickel film layer (hereinafter, referred to as a metal layer) having a thickness of 50 $\mu$m; an elastic layer 1*b* which is made of silicon rubber or the like and whose outer peripheral surface is coated; and further, a releasing layer 1*c* made of a fluorine containing resin or the like whose outer periphery is coated. The elastic layer 1*b* and releasing layer 1*c* have functions for raising a fixing performance of the toner image and improving a toner releasing performance.

When a magnetic flux acts on the metal layer 1*a* serving as a conductive layer, an eddy current is generated in the metal layer 1*a* and the metal layer 1*a* performs a magnetic induction heat generation. The metal layer 1*a* is not limited to nickel but can also use a metal or metal compound as an electric good conductor within a range from $10^{-5}$ to $10^{-10}$ Ω•cm. More preferably, it is possible to use a pure metal layer of iron, cobalt, or the like in which a permeability is high and a ferromagnetism is shown or their compound.

Even in case of a color toner image in which a thickness of toner layer is large and four color toner images are multiplexed, the elastic layer 1*b* functions for allowing the surface of the fixing film 1 to trace the concave and convex portions of the toner layer. It is proper to set a hardness to 60° (JIS-A) or less, more preferably, 45° (JIS-A) or less. It is proper to set a thermal conductivity λ to a value within a range from $6\times10^{-4}$ to $2\times10^{-3}$ [cal/cm•sec•deg.].

As a material other than the fluorine containing resin such as PFA, PTFE, FEP, or the like of the releasing layer 1*c*, it is possible to select a material having a good releasing performance and a heat resistance such as silicone resin, fluorine rubber, silicon rubber, or the like. It is preferable to set a thickness to 20 to 100 $\mu$m.

The cylindrical fixing film 1 is loosely coated around a cylindrical body constructed by a core holder 2 and a film guide member 3.

Figure 5:
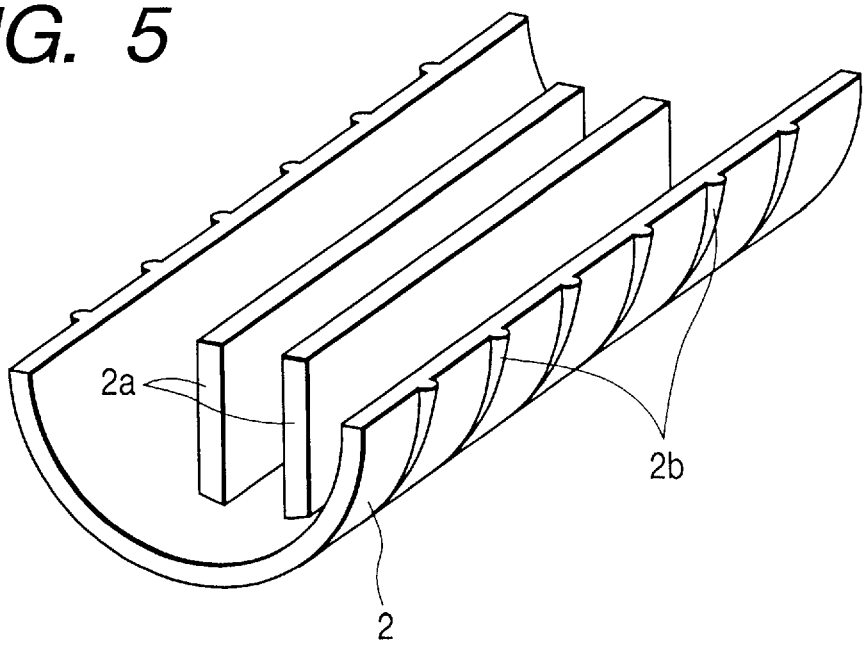
FIG. 5 is a perspective view of a holder.

The core holder 2 is a lower member. The film guide member 3 is an upper member. By overlaying the core holder and film guide member at upper and lower positions by using gutter shape each having a cross sectional view of an almost semicircular arc, an almost cylindrical body is formed. In a center portion of an inner bottom surface of the lower core holder 2, two parallel rib plates 2*a* and 2*a* are formed at an interval along the longitudinal direction of the holder. A first core 5 is dropped and held between the rib plates 2*a* and 2*a*. FIG. 5 is an external perspective view of the core holder 2. Reference numeral 2*b* denotes film inner surface guide ribs formed on the outer surface of the core holder 2 (a height of rib is set to about 0.5 mm).

The core holder 2 and film guide member 3 are electrically insulating materials with a heat resistance. For example, they are molded articles of a phenol resin, fluorine containing resin, polyimide resin, polyamide resin, polyamideimide resin, PEEK resin, PES resin, PPS resin, PFA resin, PTFE resin, FEP resin, LCP resin, or the like.

Figure 6:
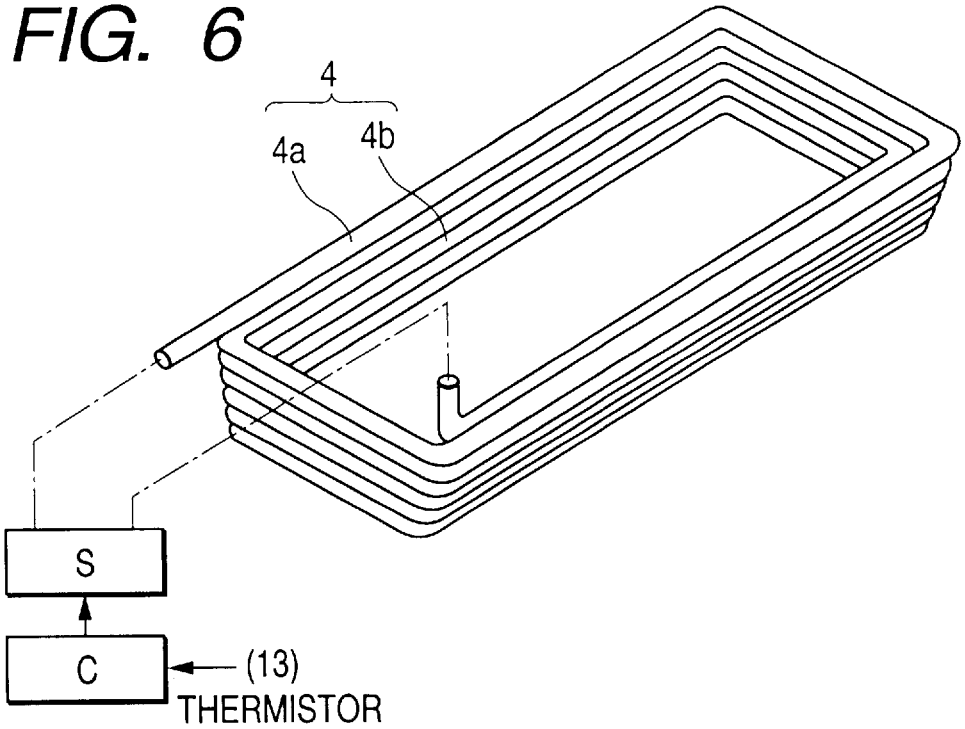
FIG. 6 is a perspective view of an exciting coil.

Reference numeral 4 denotes an exciting coil (coil) which is constructed by winding an electric wire around a ship-shaped body which almost corresponds to the inner surface of the lower core holder 2 of the gutter shape each having a cross sectional view of an almost semicircular arc. FIG. 6 is an external perspective view of the exciting coil. The exciting coil 4 of the ship-shaped body is held to the inner surface of the core holder 2.

Reference numerals 7 and 8 denote a spacer plate and a flat cover plate which are sequentially overlaid and arranged over the core holder 2 which holds the exciting coil 4 and first core 5. Reference numeral 6 denotes a pair of right and left second cores which are preliminarily adhered and held to the back surface of the spacer plate 7. By overlaying the spacer plate 7 over the core holder 2 in a predetermined manner, the second cores 6 are positioned in the upper portions on the right and left sides of the exciting coil 4 around the first core 5, thereby forming an array structure of a T-shaped cross sectional view with the first core 5.

Each of the first core 5 and second cores 6 is a laterally wide ferromagnetic member of a high permeability in which the longitudinal direction of the core holder 2 is set to be longitudinal. It is proper to use a material such as ferrite, permalloy, or the like that is often used in a core of the transformer. More preferably, it is suitable to use ferrite with a small loss at frequencies of 20 to 100 kHz.

Reference numeral 9 denotes a laterally long stay for pressurizing which is previously integratedly attached to the upper surface center portion of the flat cover plate 8. Both end portions of the stay 9 are projected outwardly than both ends in the longitudinal direction of the flat cover plate 8, respectively (FIGS. 3 and 4).

As mentioned above, the spacer plate 7 and flat cover plate 8 are sequentially covered over the core holder 2. Further, the film guide member 3 is covered. After that, the cylindrical fixing film 1 is loosely externally fitted to the assembly. Moreover, ring-shaped film edge portion restriction flange members 10 are externally fitted to both end portions of the assembly, respectively. By externally fitting the ring-shaped film edge portion restriction flange members to the core holder 2 and film guide member 3, the flange members serve as hoops, so that the assembling components 1 to 10 are held in an assembled state.

Reference numeral 15 denotes an elastic pressing roller serving as a pressurizing rotary member. The roller 15 is made up of a core 15*a* and a silicon rubber layer 15*b* which is formed concentratedly and integratedly around the core. The pressing roller 15 is arranged between the front side and the rear side (not shown) of the fixing apparatus so as to be rotatably held by a bearing.

The assembling components 1 to 10 are arranged over the pressing roller 15 in almost parallel with the roller in a manner such that the core holder 2 side is set to the lower side. On both edge sides of the laterally long stay 9 for pressurizing, pressing springs 12 are contracted and disposed between spring brackets 11 each serving as fixed members and the stay edge portions. Thus, reaction forces f of the pressing springs 12 act on the stay edge portions and the stay 9 is depressed, so that the lower surface of the core holder 2 and pressing roller 15 are pressurized by a predetermined weight (10 to 50 kg) through the fixing film 1 and a fixed nip portion N of a predetermined width is formed.

A driving force is transmitted from a driving source M to the pressing roller 15 through a driving transfer system, so that the pressing roller 15 is rotated at a predetermined peripheral velocity counterclockwise as shown by an arrow (pressing roller driving system) in FIG. 2A. In association with the rotation of the pressing roller 15, in the fixed nip portion N, a rotational force acts on the cylindrical fixing film 1 loosely fitted to the outside of the core holder 2 and film guide 3 by a frictional force between the rotary pressing roller 15 and the outer surface of the fixing film 1. Thus, the cylindrical fixing film 1 rotates clockwise shown by an arrow at a peripheral velocity almost corresponding to the rotational peripheral velocity of the pressing roller 15 while sliding in contact with the lower surface of the core holder 2 in the fixed nip portion N around the outside of the core holder 2 and film guide 3.

When the fixing film 1 rotates, the film edge portion restriction flange members 10 receive the edge portion of the fixing film 1 and function so as to restrict the shift along the longitudinal direction of the core holder of the fixing film.

The exciting coil 4 generates a high frequency magnetic field by a high frequency current (alternating current) which is supplied from an exciting circuit (a power source, a switching circuit having a capacitive impedance, and the like). The high frequency magnetic field is concentratedly distributed to an area near the fixed nip portion N by the first core 5 corresponding to the position of the fixed nip portion N. The magnetic flux of the high frequency magnetic field allows the metal layer 1*a* serving as a heat generating layer of the fixing film 1 to generate an eddy current. The eddy current allows the metal layer to generate a Joule heat by a specific resistance of the metal layer 1*a* (heat generation by an eddy current loss). That is, the metal layer 1*a* of the fixing film 1 performs a magnetic induction heat generation.

Figure 13:
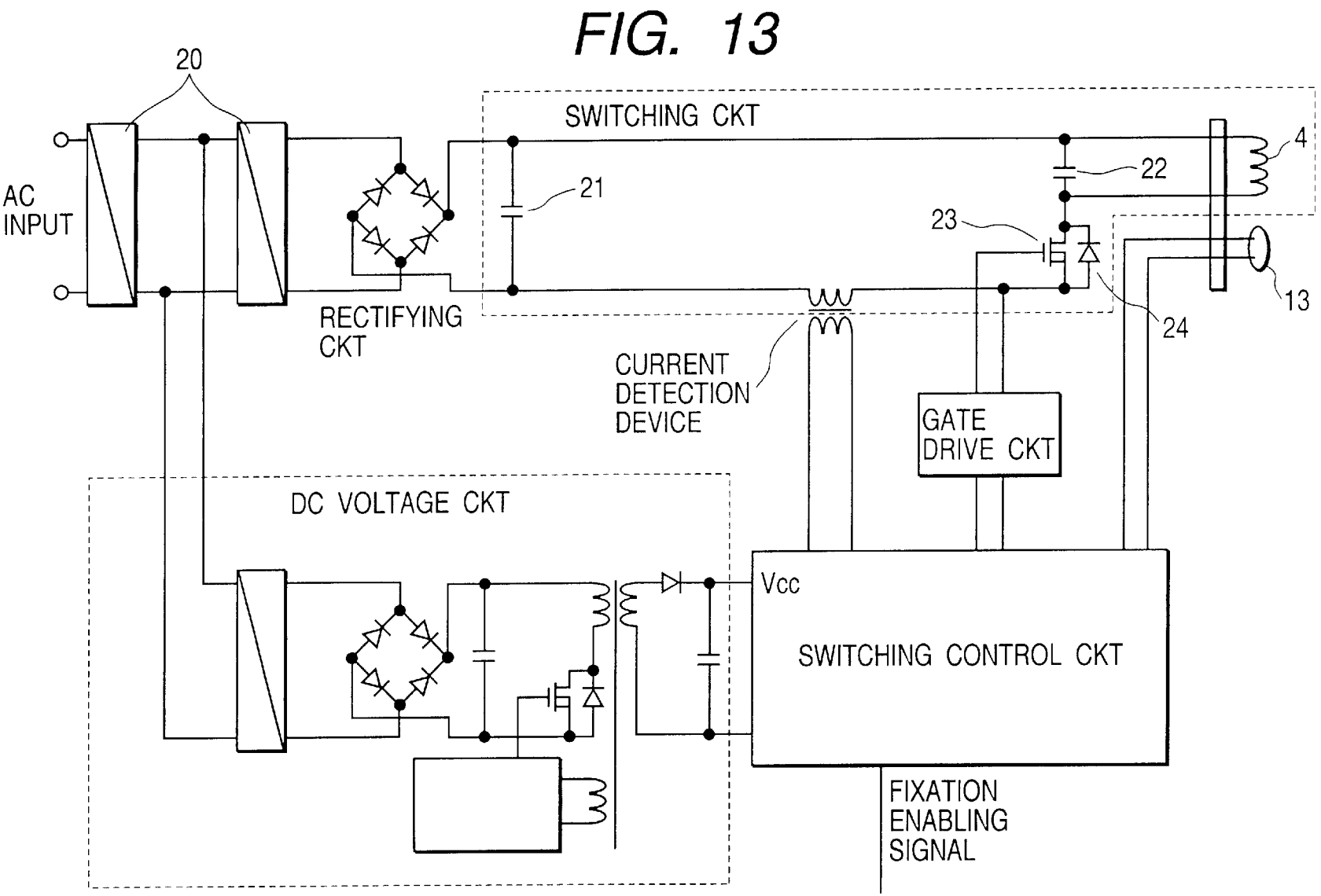
FIG. 13 is a diagram showing an exciting circuit.

FIG. 13 shows a schematic construction of an exciting circuit S. Reference numeral 20 denotes a noise filter; 21 a filter capacitor; 22 a resonant capacitor; 23 a switching element; and 24 a free-wheeling diode.

A DC power voltage circuit is a power source of a control circuit. The fixation is started by a fixation enabling signal. First, when the fixation enabling signal is inputted, a switching control circuit generates a gate pulse such that the switching element repeats proper on-time and off-time. When the switching element is turned on, a current is supplied from a rectifying circuit to an exciting coil. When the switching element is turned off, the current of the exciting coil is supplied to the resonant capacitor (to a path passing through the filter capacitor from the free-wheeling diode by a voltage). In this circuit, as the on-time is longer, a more electric power is supplied to the exciting coil and the electric power increases (heat generation amount also increases). A temperature adjustment is performed by controlling the on-time duration on the basis of temperature information detected by a thermistor 13 as temperature detecting means.

The magnetic induction heat generation of the metal layer 1*a* of the fixing film 1 concentratedly occurs near the fixed nip portion N in which the alternating magnetic flux is concentratedly distributed. The fixed nip portion N is highly efficiently heated through the elastic layer 1*b* and releasing layer 1*c*.

A temperature of the fixed nip portion N is detected by the temperature detection device 13 and its detection temperature information is inputted to a control system C (FIG. 6). The power supply (current supply) to the exciting coil 4 from the power source in an exciting circuit S is controlled by the control system C, so that the temperature of the fixed nip portion N is adjusted so as to be maintained to a predetermined temperature.

In the embodiment, the temperature detection device 13 is a thermistor arranged in the lower surface portion of the core holder corresponding to the fixed nip portion N. The thermistor 13 is formed on a thin stainless plate. The stainless plate is adhered to the outer surface of the core holder 2 and is arranged and is covered by an insulation protective tape, thereby protecting the outer surface.

In the embodiment, by concentratedly distributing the magnetic flux of the exciting coil 4 to the region near the fixed nip portion N, the generated magnetic field can be allowed to pass in a desired heating region of the metal layer 1*a* of the fixing film 1 and a high efficient fixing apparatus can be realized.

The pressing roller 15 is rotated. In association with it, the cylindrical film 1 is rotated. The magnetic induction heat generation of the fixing film 1 is performed as mentioned above by supplying a current from the exciting circuit S to the exciting coil 4. The fixed nip portion N rises to a predetermined temperature. In such a temperature adjusted state, the recording material P on which a non-fixed toner image t had been formed and was conveyed from the image forming section is fed to a position between the fixing film 1 of the fixed nip portion N and pressing roller 15 in a manner such that the image surface is faced upward, namely, the image surface faces the fixing film surface. In the fixed nip portion N, the image surface is adhered to the outer surface of the fixing film 1 and the recording material P is conveyed so as to sandwich the fixed nip portion N together with the fixing film 1. At the stage in which the recording material P is sandwiched and conveyed in the fixed nip portion N together with the fixing film 1, the recording material is heated by the magnetic induction heat generation of the fixing film 1, thereby heating and fixing the non-fixed toner image t on the recording material P. When the recording material P passes through the fixed nip portion N, it is separated from the outer surface of the rotary fixing film 1 and is ejected and conveyed.

In the embodiment, as for an exciting coil 4, a coil in which a plurality of thin copper wires each of which is insulatingly coated are bound (bundle wire) is used as an electric wire constructing the coil and the exciting coil 4 is formed by winding such a bundle wire a plurality of number of times. As an insulative coating, it is preferable to use a coating having a heat resistance in consideration of a heat conduction due to the heat generation of the fixing film 1. For example, a heat resistance temperature of the coating made of polyimide is equal to 220° C.

In FIGS. 2A and 2B, in the windings of the exciting coil 4, reference numeral 4*a* denotes a winding as a first coil portion which is adjacent to the metal layer 1*a* of the fixing film 1 through an insulating material so as to be magnetically coupled to the metal layer 1*a*. In the embodiment, the insulating material is the core holder 2. A thickness of core holder 2 is equal to 1 to 5 mm.

Reference numeral 4*b* denotes a winding as a second coil portion which is not magnetically coupled to the metal layer 1*a* of the fixing film 1 or in which a magnetic coupling with the metal layer 1*a* is weaker than that of the first winding 4*a*.

In the embodiment, the exciting coil 4 has a double-winding structure comprising the first and second windings 4*a* and 4*b*. The first and second windings 4*a* and 4*b* are mutually neighboring and are wound so as to generate the magnetic fluxes in the same direction to the metal layer 1*a* of the fixing film 1. The first and second windings 4*a* and 4*b* are serially connected and an electric power is supplied thereto from the power source by a switching circuit having a capacitive impedance. The number of turns of the second winding 4*b* is smaller than that of the first winding 4*a*.

FIG. 2B shows a state of the magnetic flux in such a construction. That is, the main magnetic flux formed mainly by the first winding passes through the second cores 6 and first core 5 having a T-shape, is magnetically coupled to the metal film 1*a* of the fixing film 1, again passes through the second core 6, and is directed to the first core 5.

There are various paths of the leakage magnetic flux which is not magnetically coupled to the metal layer 1*a* of the fixing film 1 and is formed mainly by the second winding. However, due to the effect derived from the shapes of the first core 5 and second cores 6, it is considered that a path in which the leakage magnetic flux passes through the insulating material (core holder 2) between the first winding 4*a* and the fixing film 1 on the outside of the first winding 4*a* and enters the second cores 6 and first core 5 and a path in which the leakage magnetic flux passes between the first and second windings 4*a* and 4*b* and passes through the second cores 6 and first core 5 are main paths.

Among the paths, the distance between the first winding 4*a* and the metal layer 1*a* of the fixing film 1 needs to be held to a distance such as not to deteriorate the efficiency to a certain extent without making them come into contact with each other in consideration of the efficiency and a purpose of assuring the leakage magnetic flux. In the apparatus of the embodiment, the core holder 2 functions as an insulating material between the first winding 4*a* and metal layer 1*a* and the thickness (about 1 to 5 mm) of core holder 2 provides a proper distance between the first winding 4*a* and metal layer 1*a*. In addition to it, a magnetic flux which is not coupled to the metal layer 1*a* of the fixing film 1 by the magnetic flux passing between the first and second windings 4*a* and 4*b* is assured.

Figure 7A:
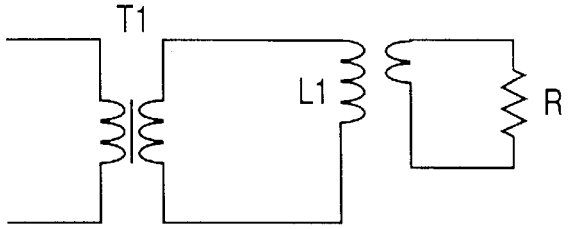
FIGS. 7A and 7B are equivalent circuit diagrams.
Figure 7B:
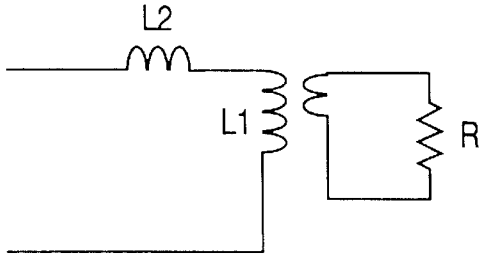

In the above construction, FIGS. 7A and 7B show equivalent circuit diagrams of the exciting coil portion. T1 denotes a matching transformer; L1 an inductance of the coil corresponding to the magnetic flux which is coupled to the fixing film; R an equivalent resistance of the fixing film (heating metal film) 1; and L2 a leakage inductance of the coil corresponding to the magnetic flux which is not coupled to the fixing film.

FIG. 7A is a circuit diagram using the conventional matching transformer T1. In case of using the matching transformer T1, even if an inductance of a load has any value, by using a proper transformer, an ideal waveform can be realized. However, the use of the transformer T1 in the actual apparatus as mentioned above is fairly difficult in terms of the size and costs. By adjusting the leakage inductance L2 in the exciting transformer 4 serving as an equivalent circuit as shown in FIG. 7B, characteristics near the ideal characteristics can be realized without using the matching transformer T1.

Figure 8A:
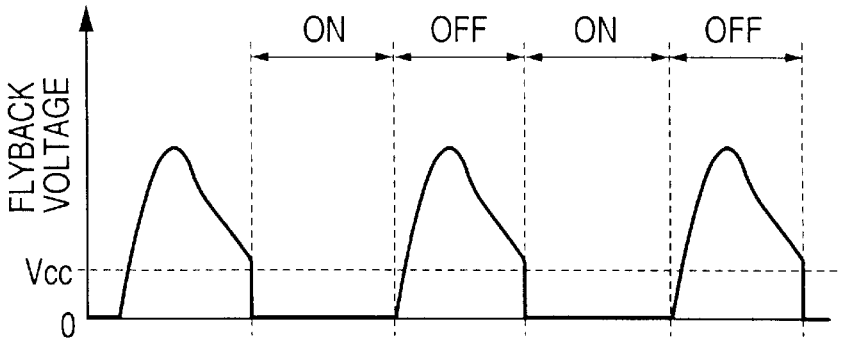
FIGS. 8A and 8B are diagrams showing flyback voltages.
Figure 8B:
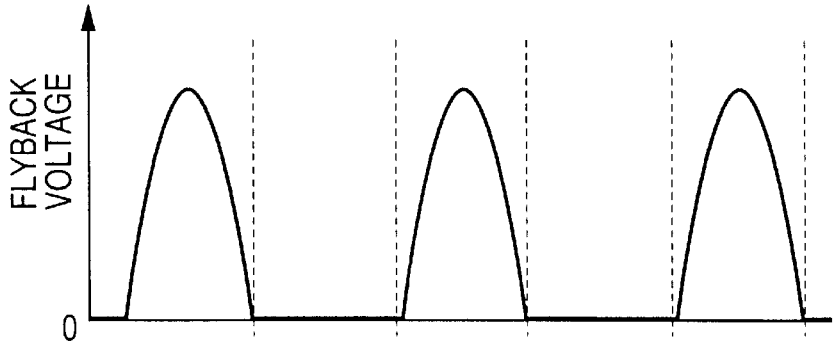

FIGS. 8A and 8B show voltage waveforms which are applied across the switching elements in the case of a system such that the magnetic coupling between the exciting coil and the metal is very good and is largely lost and the case of increasing the leakage inductance, respectively.

When a constant voltage is applied to a resonant circuit in which the exciting coil and the resonant capacitor are connected in parallel and the current supply from a constant voltage source is stopped after the elapse of a predetermined time, the current flows continuously across the coil by the energy accumulated in the magnetic field and the energy accumulated in the electric field appears as a voltage in the capacitor to supply the currents, respectively. Therefore, a voltage called a flyback voltage as shown in FIGS. 8A and 8B is generated. However, in the case where the coupling between the coil and the metal member is good and a loss by the metal is too large, the voltage is deviated from a vibrating condition as shown in FIG. 8A and intends to be converged to the voltage around Vcc (voltage applied during the on-time). In this case, the switching element is subsequently turned on in a state in which the voltage Vcc is applied. The loss due to the switching is very large.

On the other hand, by providing the second winding 4*b* and assuring the leakage magnetic flux which is not coupled to the metal layer 1*a* of the fixing film 1 as mentioned above, a swing of the flyback voltage increases as shown in FIG. 8B and the switching at a zero-cross point can be realized, so that a system with less switching loss can be realized. In other words, ideally, $$\begin{aligned}(\text{loss}) &= (\text{voltage}) \times (\text{current}) \\ &= 0 \times (\text{current}) \\ &= 0\end{aligned}$$

Therefore, an electric power in association with the switching in the switching element can be set to 0 and the switching loss can be suppressed.

Even in the case where the first and second windings 4*a* and 4*b* are come into contact with each other, the magnetic fluxes between the windings is not perfectly set off, so that such an effect can be expected. However, in order to assure the insulation property or to adjust the leakage, it is also possible to provide an insulating material between the first and second windings 4*a* and 4*b*.

According to the embodiment as mentioned above, the first winding portion in which it is a main object (first function) to magnetically couple to the heat generating member and the second winding portion in which it is a main object (second function) to assure the leakage inductance in place of magnetically sparsely coupling to the magnetic member by purposely deteriorating the magnetic coupling thereto are constructed in one exciting coil and the impedances of the first winding portion of the exciting coil and the heat generating member are matched. Therefore, the magnetic circuit in which the switching operation at a zero-cross point can be performed without needing the matching transformer can be relatively easily realized.

In case of constructing a matching coil separately from the exciting coil, it is necessary to design an enclosing space for the matching coil separately from the exciting coil. In the embodiment, however, since the first and second winding portions are neighboring and constructed as one exciting coil, there is no need to design the enclosing space for the matching coil separately from the exciting coil and the apparatus construction can be simplified.

Figure 9:
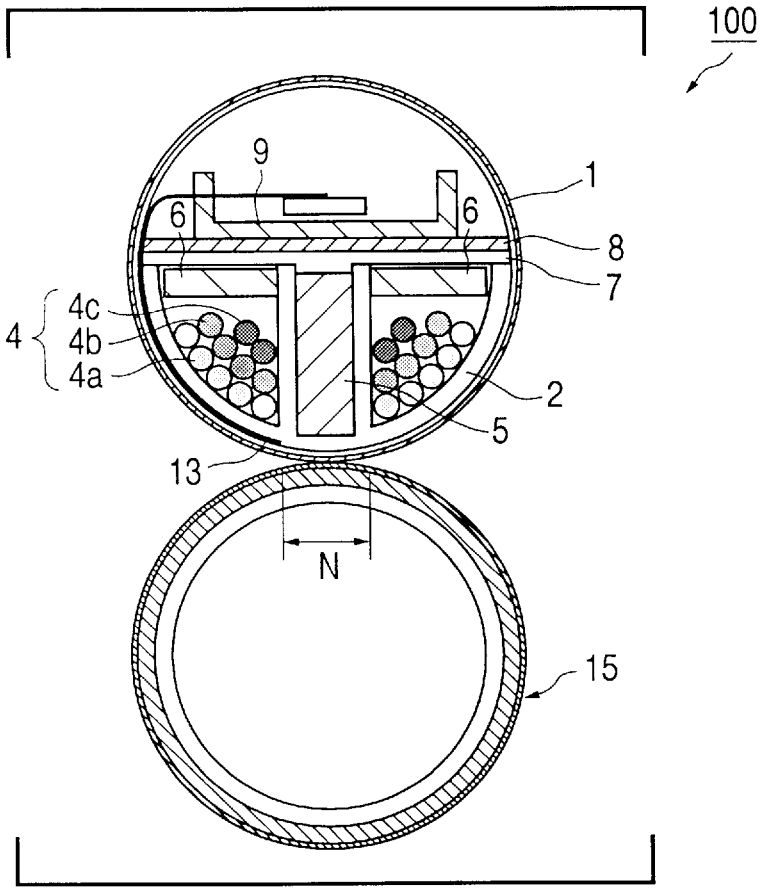
FIG. 9 is a side sectional view of an image heating apparatus according to another embodiment.

In the above example, although the winding of the exciting coil 4 has the double-layer winding of the first and second windings 4*a* and 4*b*, a multilayer winding can be also used. FIG. 9 shows such another embodiment of the invention. Even in such a case, an equivalent circuit can be also fundamentally shown like FIG. 7B. However, a leakage component of L2 is equal to the sum of inductances of the winding layers 4*a*, 4*b*, 4*c*, . . . as first layer, second layer, third layer, . . . which are not concerned with the magnetic coupling.

An effect similar to that mentioned above can be also obtained by sparsely winding the wires of the second and subsequent layers as compared with the first layer of the winding.

Figure 10A:
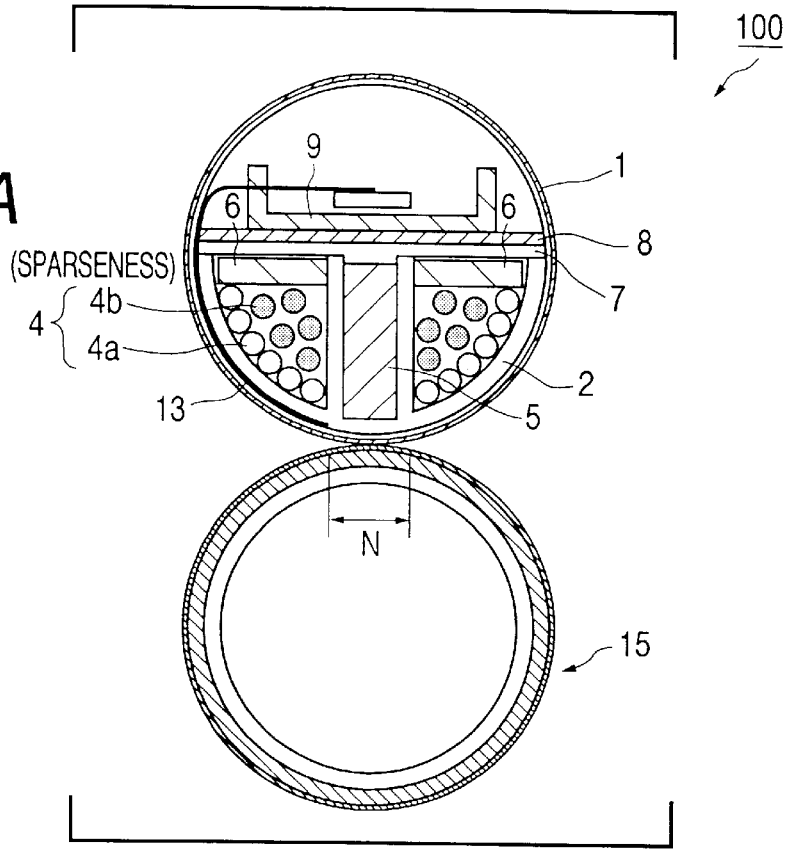
Fig. 10A is a side sectional view of the image heating apparatus according to another embodiment.
Figure 10B:
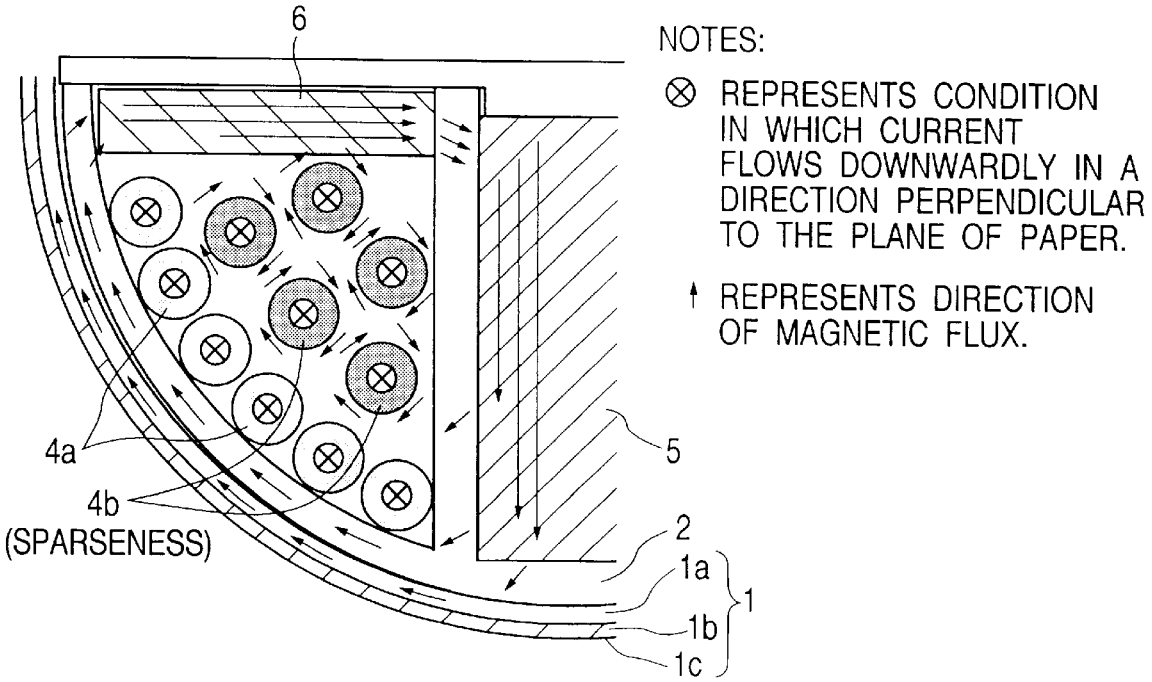
Fig. 10B is a partial enlarged diagram of the image heating apparatus.

Another embodiment of such a winding method is shown in FIG. 10A. Fig. 10B shows a state of magnetic flux in this instance.

To keep the shape of exciting coil 4, it is held by an insulating material (resin or the like) of a small thermal expansion and a high elasticity or a coated wire is used as a winding of the coil. It is also possible to form a proper supporting body by molding or the like and to wind the coil around the supporting body.

In the ideal case, the magnetic fluxes between the coils are set off and no leakage is generated. However, actually, since such a phenomenon doesn't occur and there is a tendency of increasing as the interval increases, the above structure is effective means for increasing the leakage without raising the number of turns.

As shown in FIG. 9, the winding structure is set to a winding structure of at least two or more layers and the winding of the second layer and the winding of the third layer, . . . are away from the magnetic material as a heat generator in terms of the structure, thereby obtaining the leakage inductance. Or, the windings of the second and subsequent layers from the magnetic material are sparsely wound as shown in FIGS. 10A and 10B the first function is provided for the first winding that is closest to the magnetic material, and the second function is provided for the remote second winding portion. With this construction, an enough flyback voltage to obtain a good switching state can be obtained.

Figure 11:
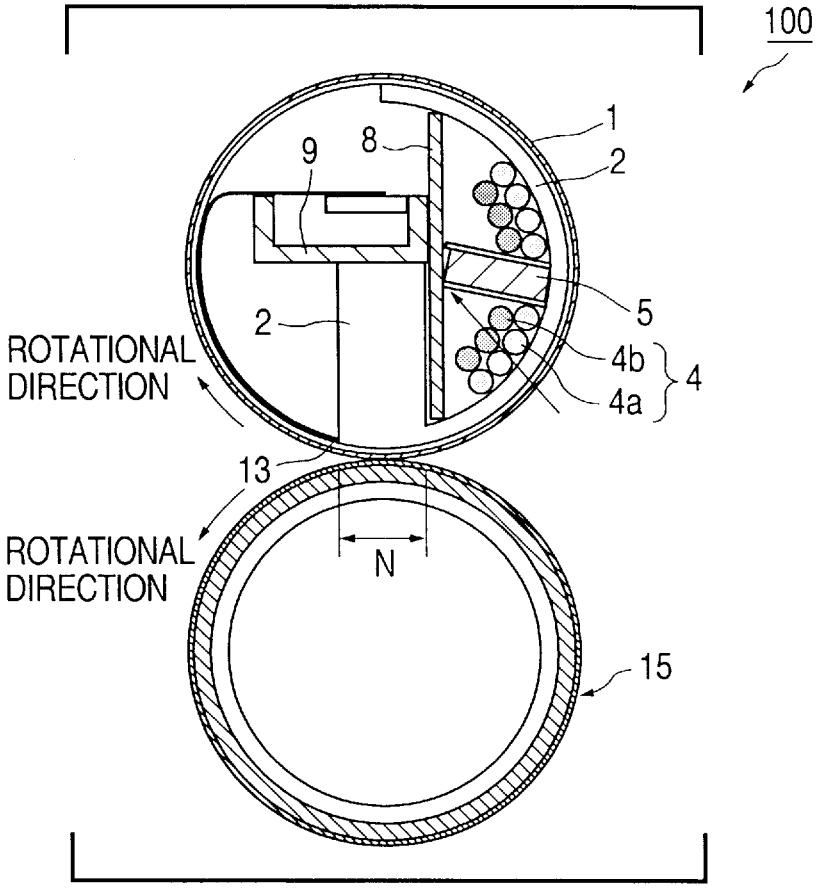
FIG. 11 is a side sectional view of the image heating apparatus according to another embodiment.

The apparatus of the embodiment has construction such that the position of the exciting coil 4 and the position of the core 5 are matched in the fixed nip portion N. However, as shown in an apparatus of FIG. 11, it is also possible to construct in a manner such that the exciting coil 4 and core 5 are arranged on the upstream side in the rotational direction of the fixing film 1 for the fixed nip portion N and the fixing film 1 is heated on the upstream side in the rotational direction of the fixing film than the fixed nip portion N and the heated portion of the film enters the fixed nip portion N by the rotation of the fixing film 1.

Figure 12:
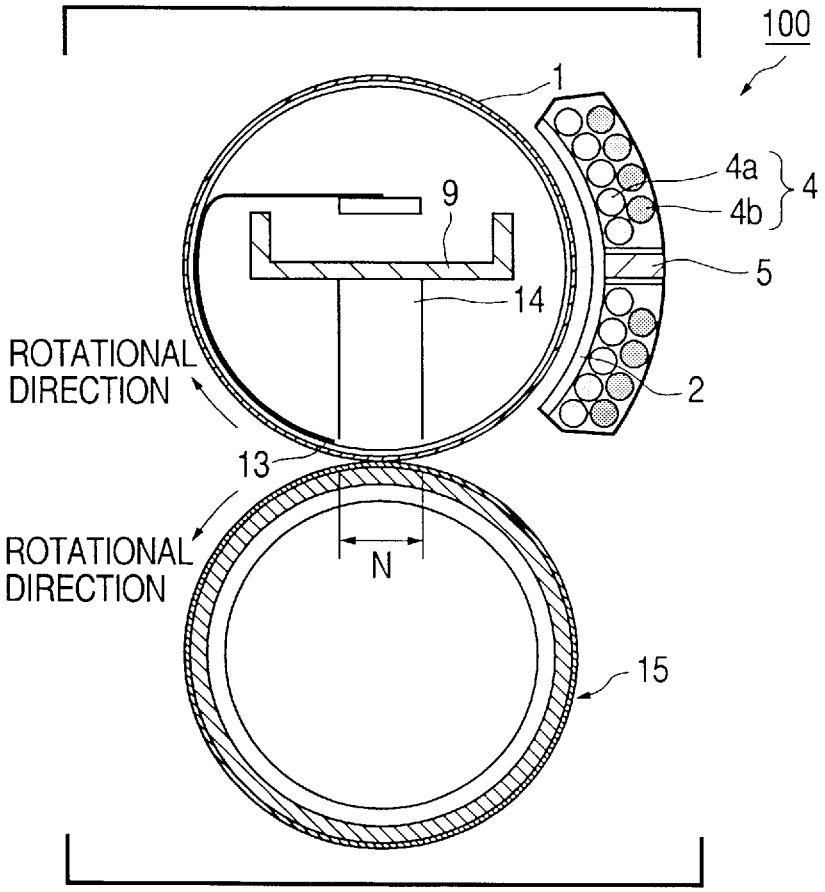
FIG. 12 is a side sectional view of the image heating apparatus according to another embodiment.

In a small apparatus in which a diameter of cylindrical fixing film is small and the exciting coil cannot be assembled in the film, as shown in an apparatus of FIG. 12, the exciting coil 4 is arranged on the upstream side in the rotational direction of the fixing film for the fixed nip portion N and the exciting coil 4 is set to a construction of two or more layers (4*a*, 4*b*, . . . ) mentioned above, a similar effect can be obtained. Reference numeral 14 denotes a facing member which faces the pressing roller 15 and forms the fixed nip portion N so as to sandwich the fixing film 1 between the pressing roller 15 and the facing member 14.

The fixing film 1 with the magnetic induction heat generating property can also have a form in which the elastic layer 1*b* is omitted in case of a film for heating and fixing a monochromatic image, a 1-path multicolor image, or the like. A layer obtained by mixing a metal filler into a resin can be also used as a magnetic layer 1*a* serving as a heat generator. A single layer member comprising only the magnetic layer 1*a* can be also used.

It is also possible to use an apparatus structure such that the upper film guide member 3 for the lower core holder 2 is omitted.

The exciting coil 4 can be also molded by an insulating resin.

The construction of the fixing apparatus 100 serving as a heating apparatus is not limited to the pressing roller driving system of the embodiment. For example, it is also possible to construct the apparatus in a manner such that an endless belt-shaped fixing film is suspended with tension among a plurality of members such as driving roller, tension roller, and the like and the fixing film is rotated by the members other than the pressing roller. It is also possible to use an apparatus construction such that an elongated web-shaped member obtained by winding a fixing film in a roll shape is used and is wound and run and moved at a predetermined speed from the supply reel side to the take-up reel side.

It is also possible to use an apparatus construction such that a fixed member is used as a magnetic material serving as an electromagnetic induction heat generating member. For example, an iron plate is fixedly arranged as a fixed magnetic material to the fixed nip portion, a magnetic induction heat generation is caused in the iron plate by the exciting coil, and the fixed iron plate and the pressing roller serving as a pressurizing member are come into pressure contact with each other through a thin film of a heat resistance, thereby forming the fixed nip portion N. The heat resistant film is rotated or run and moved in the fixed nip portion by the pressing roller driving system or the driving roller or take-up reel in a state in which the inside surface of the film slides the lower surface of the fixed iron plate in contact therewith. The fixed iron plate concentratedly receives the alternating magnetic flux which is developed by applying an alternating current to the exciting coil and causes the magnetic induction heat generation. At a stage in which the recording member is fed between the heat resistant film of the fixed nip portion and the pressing roller and is conveyed so as to sandwich the fixed nip portion together with the heat resistant film, the recording material receives the heat generation energy of the fixed iron plate through the heat resistant film and is heated, so that the toner image is fixed.

The pressing member 15 is not limited to the roller member but can also use a member of another form such as a rotary belt type or the like.

In order to also supply a thermal energy to the recording material from the pressing member 15 side, it is also possible to construct the apparatus in a manner such that heating means such as an electromagnetic induction heating or the like is also provided for the pressing member 15 side, thereby heating and adjusting to a predetermined temperature.

The image forming principle and system of the image forming apparatus are not limited to the electrophotographing process but can also use another process such as electrostatic recording process, magnetic recording process, or the like of the transfer system or direct system.

The heating apparatus of the invention is not limited to the image heating fixing apparatus of the embodiment but can be also widely used as means or apparatus for heating a material to be heated such as image heating apparatus for heating a recording material holding an image and for improving a surface property such as a glossy surface or the like, image heating apparatus for temporarily fixing an image, heating drying apparatus of a material to be heated, heating laminating apparatus, or the like.

Although the invention has been described above with respect to the preferred embodiments, the present invention is not limited to the foregoing embodiments but many modifications and variations are possible within the spirit and scope of the appended claims of the invention.

What is claimed is:

1. An image heating apparatus comprising:

a heat generating member having a conductive layer; and magnetic field generating means for generating a magnetic field, said magnetic field generating means having an exciting coil to which an electric power is supplied from a power source by a switching circuit;

wherein an eddy current is generated in said heating member by the magnetic field generated by said magnetic field generating means and said heat generating member generates a heat by said eddy current, so that an image on a recording material is heated by said heat, and wherein said exciting coil has a first coil portion, and a second coil portion for matching an impedance of said first coil portion and an impedance of said heat generating member, both of which are mutually neighbored.

2. An apparatus according to claim 1, wherein a magnetic coupling between said second coil portion and said heat generating member is weaker than a magnetic coupling between said first coil portion and said heat generating member.

3. An apparatus according to claim 1, wherein said second coil portion is away from said heat generating member than said first coil portion.

4. An apparatus according to claim 1, wherein said first coil portion and said second coil portion are serially connected.

5. An apparatus according to claim 1, wherein the number of turns of said second coil portion is smaller than the number of turns of said first coil portion.

6. An apparatus according to claim 1, further comprising a supporting member for supporting said exciting coil and located between said heat generating member and said exciting coil.

7. An apparatus according to claim 6, wherein said supporting member is an electrically insulating material.

8. An apparatus according to claim 1, wherein a density of windings of said second coil portion is smaller than a density of windings of said first coil portion.

9. An apparatus according to claim 1, wherein said heat generating member is an endless film.

10. An apparatus according to claim 9, wherein said exciting coil is located inside of said film.

11. An apparatus according to claim 1, further comprising a backup member for forming a nip together with said heat generating member, wherein a recording material holding a non-fixed image is sandwiched and conveyed by said nip, and said non-fixed image is fixed onto the recording material.

* * * * *

UNITED STATES PATENT AND TRADEMARK OFFICE

CERTIFICATE OF CORRECTION

PATENT NO. : 5,819,150

DATED : October 6, 1998

INVENTORS : MINORU HAYASAKI, ET AL.

It is certified that error appears in the above-identified patent and that said Letters Patent is hereby corrected as shown below:

COVER PAGE [57] ABSTRACT,
Line 18, "away" should read --further away--.

COLUMN 13,
Line 7, "away" should read --further away--.

Signed and Sealed this

Fourth Day of May, 1999

*Attest:*

*Attesting Officer*

Q. TODD DICKINSON

*Acting Commissioner of Patents and Trademarks*